United States Patent [19]

Schmitz et al.

[11] 3,938,216

[45] Feb. 17, 1976

[54] HANDLE MOUNTING MEANS FOR POWER DRIVEN VACUUM CLEANER

[75] Inventors: Joseph F. Schmitz, St. Paul; Ute K. Malz, Afton; Erwin Nordeen, St. Paul, all of Minn.

[73] Assignee: Whirlpool Corporation, Benton Harbor, Mich.

[22] Filed: Feb. 10, 1975

[21] Appl. No.: 548,408

[52] U.S. Cl. ..... 15/340; 180/19 H

[51] Int. Cl.[2] ..... A47L 5/00; B62D 1/00

[58] Field of Search.... 15/49 R, 49 RB, 49 C, 50 R, 15/50 A, 50 C, 98, 340, 350, 351; 180/19 H; 200/61.85, 153 K; 55/357, 358

[56] References Cited

UNITED STATES PATENTS

| | | | |
|---|---|---|---|
| 3,225,853 | 12/1965 | Norton et al. | 180/19 H |
| 3,557,893 | 1/1971 | Kohls | 180/19 H |
| 3,854,164 | 12/1974 | Schmitz | 15/340 |

*Primary Examiner*—Edward L. Roberts

*Attorney, Agent, or Firm*—Wegner, Stellman, McCord, Wiles & Wood

[57] ABSTRACT

An improved mounting structure for movably mounting the handle of a power driven vacuum cleaner including spring biasing structure urging the handle to a central neutral position and permitting the user of the vacuum cleaner to effect selective forward and rearward movement of the vacuum cleaner by suitable manipulation of the handle against the action of the spring biasing structure. The spring biasing structure is defined by a cartridge which is mounted in a tubular portion of the handle. Improved bearing structures are provided for providing facilitated longitudinal reciprocation of the handle for facilitated control of the forward and reverse operation of the vacuum cleaner.

18 Claims, 6 Drawing Figures

HANDLE MOUNTING MEANS FOR POWER DRIVEN VACUUM CLEANER

BACKGROUND OF THE INVENTION

1. Field of the Invention

This invention relates to vacuum cleaners and in particular to means for movably mounting the handle of a power driven vacuum cleaner for facilitated control of the movement of the vacuum cleaner by suitable manipulation of the handle.

2. Description of the Prior Art

In Thomas E. Hetland U.S. Pat. No. 3,857,076 for an Upright Vacuum Cleaner Drive Motor Control, an improved means for controlling the movement of a self-propelled vacuum cleaner is disclosed. Said patent is owned by the assignee hereof. The handle mounting means of the present invention comprises a further improvement in the means for mounting the handle of such a self-propelled vacuum cleaner.

As pointed out in said patent, the prior art shows the use of propelling means in devices such as automobiles, lawnmowers, golf bag carriers, and golf carts, wherein the propelling means comprise self-contained motor driven power means. The art further shows the use of push-pull longitudinally movable controls as in electrical switches, dental instruments, lawnmowers, golf carts, etc. It is further known to provide in vacuum cleaners, motor driven suction fans and motor driven agitators.

In said patent, the reversible drive of the vacuum cleaner is controlled by longitudinal movement of the handle which extends into the bag housing to carry internally thereof a cam which is selectively engageable with a pair of switches for controlling the operation of the drive motor. The handle carries a central spring actuating means for coaction with a pair of coil springs associated with the cam means to bias the handle to a central neutral position.

SUMMARY OF THE INVENTION

The present invention comprehends an improved means for movably mounting the handle of such a power driven vacuum cleaner for improved control of the movement thereof.

More specifically, the present invention comprehends an improved handle mounting means wherein bearing means are provided on the bag housing for providing facilitated reciprocal movement of the handle relative to the housing. The handle is biased to a central neutral position by means of a biasing assembly comprising a cartridge installed in a tubular end of the handle and carrying a pair of biasing springs.

Stop means are secured to the bag housing and extend into the cartridge for selectively deflecting the springs as a result of manipulation of the handle whereby suitable selective movement of the vacuum cleaner is effected. Upon release of the handle by the operator, the spring means of the cartridge return the handle to the neutral position.

The cartridge assembly comprises a molded plastic means permitting facilitated assembly of the springs relative to the stop means and permitting facilitated installation in the tubular end of the handle.

The bearing means may comprise ball bearing means and effectively provide a smooth facilitated movement of the handle as a result of manipulation thereof by the operator.

The handle assembly is extremely simple and economical of construction and may be readily assembled in the vacuum cleaner. As the cartridge effectively controls the deflection of the springs in effecting biasing of the handle to the neutral position, uniformity in the biasing means is provided. To compensate for the weight of the handle, the springs may have a differential compression as controlled by the dimensions of the cartridge.

The bearings may be provided with metal bearing holders mounted in a synthetic plastic portion of the bag housing for improved long life and maintained low friction movement of the handle. The cartridge may comprise a molded synthetic plastic cartridge for improved uniformity in the biasing action.

Thus, the present invention comprises an improved handle biasing means in a power driven vacuum cleaner.

BRIEF DESCRIPTION OF THE DRAWING

Other features and advantages of the invention will be apparent from the following description taken in connection with the accompanying drawing wherein.

DESCRIPTION OF THE PREFERRED EMBODIMENT

Figures 1, 2, 3, 4, 5, 6:
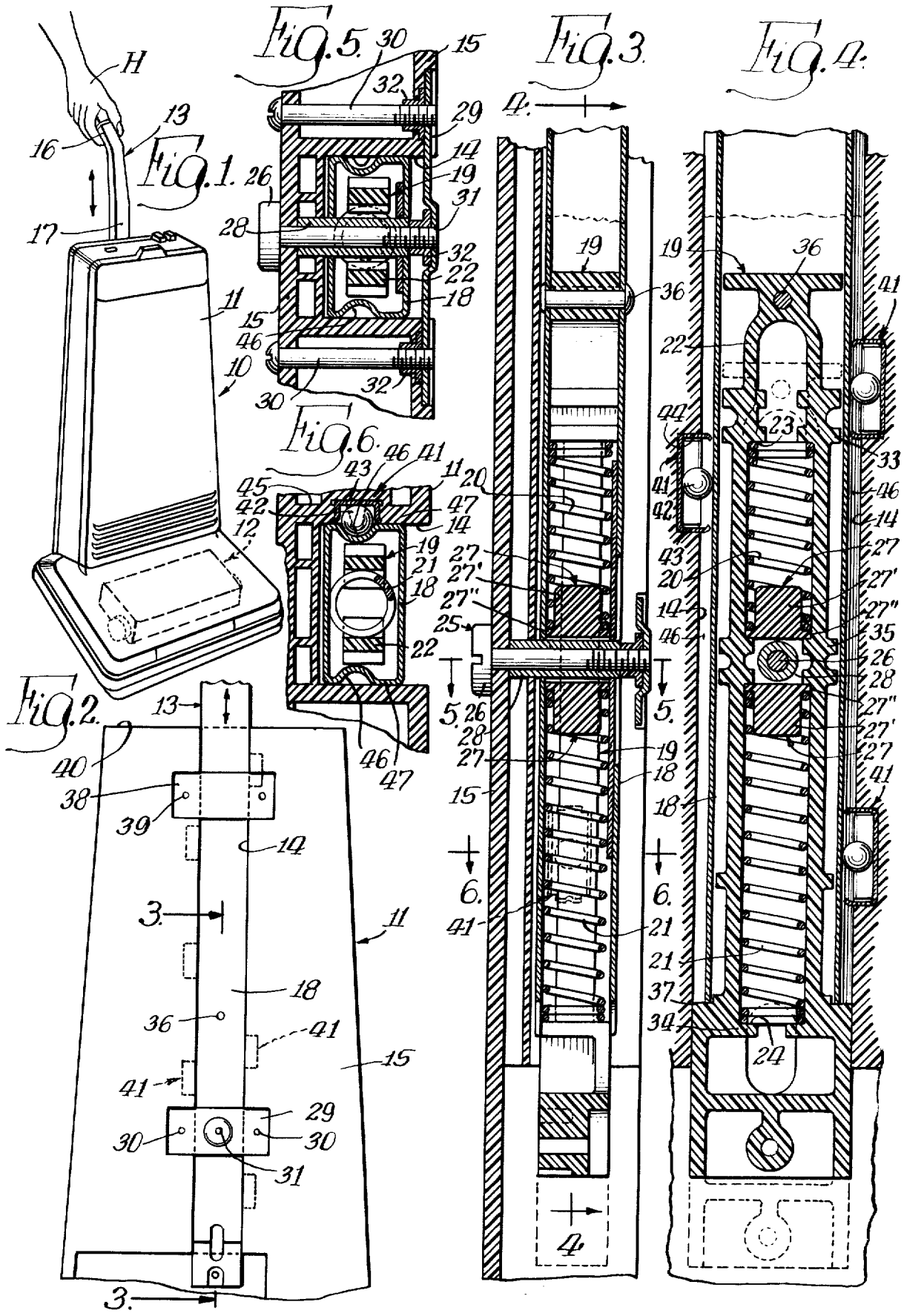
FIG. 1 is a perspective view of a vacuum cleaner having a handle biasing means embodying the invention.
FIG. 2 is a fragmentary rear elevation thereof.
FIG. 3 is a longitudinal section taken substantially along the line 3—3 of FIG. 2.
FIG. 4 is a transverse longitudinal section taken substantially along the line 4—4 of FIG. 3.
FIG. 5 is a horizontal section taken substantially along the line 5—5 of FIG. 3.
FIG. 6 is a horizontal section taken substantially along the line 6—6 of FIG. 3.

In the exemplary embodiment of the invention as disclosed in the drawing, a vacuum cleaner generally designated 10 is shown to comprise a power driven vacuum cleaner having a bag housing 11 and motor driven wheeled means generally designated 12 for reversibly moving the vacuum cleaner over a surface to be cleaned. Operation of the reversible driving means is effected by suitable manipulation of a handle generally designated 13 as by a user's hand H, as shown in FIG. 1, moving the handle fowardly or rearwardly in a manner similar to that effected in the manipulation of a conventional nonpower driven vacuum cleaner. It is desirable in such power driven vacuum cleaners to provide the driving action with effectively minimum force by the user so that the vacuum cleaner is substantially instantaneously responsive to the manipulation of the handle. The present invention comprehends an improved means for mounting the handle 13 in the vacuum cleaner which provides such improved facilitated control of the handle movement.

In the illustrated embodiment, the handle is movably mounted to the bag housing 11 in a rearwardly vertically extending channel 14 in the rear wall 15 thereof. Handle 13 includes a distal manipulation portion 16, a connecting portion 17, and a lower carrier portion 18. Carrier portion 18 is movably received in channel 14 for vertical reciprocal displacement, as illustrated in FIG. 2. Carrier portion 18 comprises a tubular portion in which is received a cartridge generally designated 19 provided with a pair of springs 20 and 21 for biasing the handle to a central neutral position as shown in FIGS. 4 and 5.

Cartridge 19 comprises a molded synthetic plastic element 22 defining a pair of reaction surfaces 23 and 24 spaced outwardly from central stop means generally designated 25. As best seen in FIGS. 3 and 5, stop means 25 comprises a screw 26 carried by the rear wall 15 of the bag housing and projecting outwardly through the tubular carrier portion 18 of the handle and cartridge 19 mounted therein. A tubular spacer 28 is provided on the screw 26. A retaining plate 29 is secured to the bag housing by suitable screws 30. Suitable weld nuts 32 are provided on plate 29 for receiving screws 26 and 30. Spring inserts 27 are positioned inside the turns of springs 20 and 21 at their ends adjacent stop means 25. The spring inserts 27 facilitate assembly of the cartridge 19 and also serve to keep springs 20 and 21 in proper location during operation. The spring inserts include a tubular portion 27′ dimensioned to fit inside the coils of springs 20 and 21 and a flange portion 27″ overlying the ends of the respective springs.

Springs 20 and 21 herein comprise coil springs extending between the stop means 25 and opposite spaced reaction surfaces 23 and 24 to provide the desired biasing of the handle to the central neutral position. Surface 23 is defined by a wall portion 33 of the cartridge element 22 and surface 24 is defined by a wall portion 34 of the cartridge element 22, which wall portions are accurately located relative to the mid-portion 35 of the cartridge element 22, as illustrated in FIG. 4. The cartridge element is fixedly secured to the tubular carrier portion by suitable securing means, such as rivet 36. The cartridge element may be provided with a further end wall portion 37 limiting the insertion of the element into the tubular carrier portion 18 of the handle, as illustrated in FIG. 4, for accurately positioning the cartridge relative to the handle in the assembled relationship of the handle mounting structure.

As shown in FIG. 2, a second retaining plate 38 may be secured to the bag housing by suitable screws 39 adjacent the upper end 40 of the bag housing for cooperating with retaining plate 29 in retaining the handle carrier portion 18 within the channel 14. Facilitated reciprocal displacement of the handle is provided herein by suitable bearing means generally designated 41, herein comprising ball bearings 42, received in suitable metal bearing holders 43 disposed in suitable recesses 44 at spaced positions along the longitudinal extent of the channel 14. As best seen in FIG. 6, each bearing holder 43 is received in a side wall 45 of the channel 14 with the ball bearing 42 projecting outwardly therefrom into a longitudinal groove 46 in the side walls 47 of the carrier portion 18. Bearings 41 provide a low friction mounting of the handle to the bag housing which permits movement of the handle with minimum force by the user so as to provide highly sensitive control of the vacuum cleaner movement thereby effectively minimizing fatigue and facilitating the vacuum cleaner operation.

Upon displacement of the handle from the central neutral position, the corresponding movement of cartridge 19 causes a compression of one of the springs 20 and 21 and a relaxation of the other of the springs depending on the direction of manipulation of the holder. More specifically, one of the springs is compressed between the reaction surface associated therewith and the stop means 25 as the central wall portion 35 moves away from the inner end of the spring. At the same time, stop means 25 moves away from the inner end of the opposite spring permitting that spring to remain compressed between the wall means 35 and its associated reaction surface without any biasing effect at that time. Thus, in manipulating the handle, the user selectively compresses one or the other of the biasing springs which, upon release of the handle, immediately restores the handle to the central neutral position. The restoration of the handle is facilitated by the low friction mounting of the handle in the bag housing channel afforded by the ball bearing mounting means. Resultingly, fingertip manipulation of the handle may be utilized in effecting the controlled movement of the vacuum cleaner to provide an improved facilitated cleaning operation.

As the cartridge element 22 may be molded, high accuracy in the spacing of the walls 33, 34 and 35 is provided for improved production efficieny and economy. The handle mounting means is readily assembled and may be readily disassembled for facilitated servicing as desired.

In the illustrated embodiment, the spacing of wall 33 from wall 35 is less than the spacing of wall 34 from wall 35 to provide a differential biasing effect relative to the springs 20 and 21 which are resultingly differentially compressed so as to provide different preloading thereof. Thus, spring 20 is preloaded to a greater extent than spring 21 to accommodate the weight of the handle in providing a disposition of the handle in the desired central neutral position.

The retaining plates 29 and 38 serve to retain the handle carrier portion 18 against displacement outwardly from the channel 14 and, thus, effectively, permit handle carrier portion 18 to, in turn, retain the bearing means 41 in the side walls 45 so that, in effect, the retaining plates serve both to retain the handle in movable association with the bag housing and the bearing means in mounted association therewith.

The foregoing disclosure of specific embodiments is illustrative of the broad inventive concepts comprehended by the invention.

Having described the invention, the embodiments of the invention in which an exclusive property or privilege is claimed are defined as follows:

1. In a power driven vacuum cleaner having a bag housing, selectively operable means for reversibly driving the vacuum cleaner, and a manipulating handle, an improved mounting structure for movably mounting the handle for controlling the selectively operable means, said mounting structure comprising:

bearing means movably supporting said handle on said bag housing for reciprocable movement of the handle from and to a central neutral position; and a biasing assembly for biasing said handle to said neutral position including stop means fixedly retained to said bag housing, means movable with said handle defining a pair of reaction surfaces spaced oppositely from said stop means, a first selectively deflectible spring extending between said stop means and one of said reaction surfaces, and a second selectively deflectible spring extending between said stop means and the other of said reaction surfaces, said springs cooperatively urging said handle to said central neutral position.

2. The vacuum cleaner handle mounting structure of claim 1 wherein said biasing assembly includes a cartridge attached to said handle and defining said reaction surfaces and spring means.

3. The vacuum cleaner handle mounting structure of claim 1 wherein said handle is tubular and said biasing assembly includes a cartridge mounted in and attached to said tubular handle and defining said reaction surfaces and spring means.

4. The vacuum cleaner handle mounting structure of claim 1 wherein said bearing means comprises ball bearing means carried by said bag housing.

5. The vacuum cleaner handle mounting structure of claim 1 wherein said bag housing defines a channel receiving said handle for longitudinal reciprocal movement therein.

6. The vacuum cleaner handle mounting structure of claim 1 wherein said bag housing defines a channel receiving said handle for longitudinal reciprocal movement therein and said bearing means comprises ball bearing means carried by said bag housing, and further including retaining means retaining said handle in said channel and removably maintaining said bearing means mounted to said bag assembly.

7. The vacuum cleaner handle mounting structure of claim 1 wherein said springs are compressible and said reaction surfaces are disposed to provide a compression of said first spring different from that of said second spring when said handle is in said neutral position.

8. In a power driven vacuum cleaner having a bag housing, selectively operable means for reversibly driving the vacuum cleaner, and a manipulating handle, an improved mounting structure for movably mounting the handle for controlling the selectively operable means, said mounting structure comprising:

means movably supporting said handle on said bag housing for reciprocable movement of the handle from and to a central neutral position;

stop means fixedly retained to said bag housing; and a cartridge comprising a mounting element carried by said handle and defining a pair of reaction surfaces spaced oppositely from said stop means, a first spring disposed within said mounting element selectively compressible between said stop means and the other of said reaction surfaces, said springs cooperatively urging said handle to said central neutral position.

9. The vacuum cleaner handle mounting structure of claim 8 wherein said handle defines a tubular portion and said cartridge is received in said tubular portion.

10. The vacuum cleaner handle mounting structure of claim 8 wherein said handle defines a tubular portion and said cartridge is received in said tubular portion, said stop means extending from said bag housing through said tubular portion into said cartridge.

11. The vacuum cleaner handle mounting structure of claim 8 wherein said mounting element comprises a molded plastic element, and said reaction surfaces comprise wall means integrally molded in said element.

12. The vacuum cleaner handle mounting structure of claim 8 wherein said handle defines a tubular portion and said cartridge is received in said tubular portion, said mounting structure further including securing means fixedly securing said cartridge to said handle portion.

13. In a power driven vacuum cleaner having a bag housing, selectively operable means for reversibly driving the vacuum cleaner, and a manipulating handle, an improved mounting structure for movably mounting the handle to the bag housing for controlling the selectively operable means, said mounting structure comprising:

means on said handle defining a tubular carrier portion;

ball bearing means movably supporting said carrier portion on said bag housing for reciprocable movement of the handle from and to a central neutral position;

stop means fixedly retained to said bag housing; and a cartridge defining means for biasing said carrier to said neutral position, said cartridge including means movable with said carrier portion defining a pair of reaction wall means spaced oppositely from said stop means, a first selectively deflectible coil spring extending between said stop means and one of said reaction wall means, and a second selectively deflectible coil spring extending between said stop means and the other of said reaction wall means, said springs cooperatively urging said carrier and handle to said central neutral position.

14. The vacuum cleaner handle mounting structure of claim 13 wherein said reaction wall means are disposed to provide a compression of said first spring different from that of said second spring when said handle is in said neutral position.

15. The vacuum cleaner handle mounting structure of claim 13 wherein said springs comprise selectively compressible coil springs.

16. The vacuum cleaner handle mounting structure of claim 13 wherein said stop means further defines means for retaining the handle carrier portion in mounted association with the bag housing.

17. The vacuum cleaner handle mounting structure of claim 13 wherein said cartridge is fixedly secured to said handle carrier portion.

18. The vacuum cleaner handle mounting structure of claim 13 including spring insert means for the stop means end of said first and second springs including a tubular portion positioned inside the coils of said springs and a circular flange overlying the stop means end of said first and second springs.

* * * * *